US006076367A

United States Patent [19]

Sandofsky et al.

[11] Patent Number: 6,076,367

[45] **Date of Patent: *Jun. 20, 2000**

[54] VARIABLE SPEED LIQUID REFRIGERANT PUMP

[75] Inventors: Marc D. Sandofsky, Natick; David F. Ward, Framingham, both of Mass.

[73] Assignee: JDM, Ltd., Worchester, Mass.

[ * ] Notice: This patent is subject to a terminal disclaimer.

[21] Appl. No.: 09/066,306

[22] PCT Filed: Oct. 25, 1996

[86] PCT No.: PCT/US96/17147

§ 371 Date: Oct. 26, 1998

§ 102(e) Date: Oct. 26, 1998

[87] PCT Pub. No.: WO97/18420

PCT Pub. Date: May 22, 1997

Related U.S. Application Data

[63] Continuation of application No. 08/548,690, Oct. 25, 1995, Pat. No. 5,749,237, which is a continuation-in-part of application No. 08/380,739, Jan. 30, 1995, abandoned, which is a continuation of application No. 08/127,976, Sep. 28, 1993, Pat. No. 5,435,148.

[51] Int. Cl.[7] ..... F25B 1/00

[52] U.S. Cl. ..... 62/209; 62/209; 62/498

[58] Field of Search ..... 62/DIG. 2, DIG. 17, 62/209, 498

[56] References Cited

U.S. PATENT DOCUMENTS

| | | | |
|---|---|---|---|
| 3,081,606 | 3/1963 | Brose et al. | 62/DIG. 2 X |
| 5,386,700 | 2/1995 | Hyde | 62/DIG. 2 X |
| 5,749,237 | 5/1998 | Sandofsky et al. | 62/DIG. 2 X |

*Primary Examiner*—William Wayner
*Attorney, Agent, or Firm*—Blodgett & Blodgett, P.C.

[57] ABSTRACT

The invention entails the use of a positive displacement pump (41) magnetically coupled to a drive motor (42) located in a conduit arrangement (60) which is parallel to the liquid line (22) of the refigeraton system as in FIG. 5. This parallel conduit arrangement (60) also includes a pressure regulating valve (45) that will regulate the amount of pressure added to the liquid line (22) by the parallel pump and piping arrangement (60). In addition, a check valve (47) is located in the liquid line (22) to maintain the pressure differential added to the liquid line. This parallel piping arrangement (60) is desirable in order to allow a constant predetermined pressure to be added to the liquid line regardless of variations in flow rate of the liquid refrigerant. The present invention involves the use of a controlled variable speed drive on the pump meter so the flow rate through the pump will more closely match the variable system flow.

15 Claims, 16 Drawing Sheets

VARIABLE SPEED LIQUID REFRIGERANT PUMP

CROSS REFERENCE TO RELATED APPLICATIONS

This application is a continuation of application, Ser. No. 08/548,690, filed Oct. 25, 1995, now U.S. Pat. No. 5,749,237, which was a continuation-in-part of application Ser. No. 08/380,739, filed Jan. 30, 1995, now abandoned, which was a continuation of application Ser. No. 08/127,976, filed Sep. 28, 1993, now U.S. Pat. No. 5,435,148.

This application is also the National Stage of Patent Cooperation Treaty application Ser. No. PCT/US96/17147, filed Oct. 26, 1996.

STATEMENT REGARDING FEDERALLY SPONSORED RESEARCH OR DEVELOPMENT

This invention has created without the sponsorship or funding of any federally sponsored research or development program.

1. Field of the Invention

This invention generally relates to the field of mechanical refrigeration and air conditioning and more particularly to improving efficiency of compression-type refrigeration and air conditioning systems.

2. Background of the Invention

In the operation of commercial freezers, refrigerators, air conditioners and other compression-type refrigeration systems, it is desirable to maximize refrigeration capacity while minimizing total energy consumption. Specifically, it is necessary to operate the systems at as low a compression ratio as possible without the loss of capacity that normally occurs when compressor compression ratios are reduced. This is accomplished by suppressing the formation of "flash gas" Flash gas is the spontaneous flashing or boiling of liquid refrigerant resulting from pressure losses in refrigeration system liquid refrigerant lines. Various techniques have been developed to eliminate flash gas. However, conventional methods for suppressing flash gas can substantially reduce system efficiency by increasing energy consumption.

FIG. 1 represents a conventional mechanical refrigeration system of the type typically used in a supermarket freezer. Specifically, compressor 10 compresses refrigerant vapor and discharges it through line 20 into condenser 11. Condenser 11 condenses the refrigerant vapors to the liquid state by removing heat aided by circulating fan 31. The liquid refrigerant next flows through line 21 into receiver 12. From receiver 12, the liquid refrigerant flows through line 22 to counter-flow heat exchanger (not shown). After passing through exchanger, the refrigerant flows via line 23 through thermostatic expansion valve 14. Valve 14 expands the liquid refrigerant to a lower pressure liquid which flows into and through evaporator 15 where it evaporates back into a vapor, absorbing heat. Valve 14 is connected to bulb 16 by capillary tube, 30. Bulb 16 throttles valve 14 to regulate temperatures produced in evaporator 15 by the flow of the refrigerant. Passing through evaporator 15, the expanded refrigerant absorbs heat returning to the vapor state aided by circulating fan 32. The refrigerant vapor then returns to compressor 10 through line 24.

In order to keep the refrigerant in a liquid state in the liquid line, the refrigerant pressure is typically maintained at a high level by keeping the refrigerant temperature at condenser 11 at a minimum of approximately 95° F. This minimum condensing temperature maintains pressure levels in receiver 12 and thus the liquid lines 22 and 23 above the flash or boiling point of the refrigerant. At 95° F. condensing temperature, this pressure for example would be; 125 PSI for refrigerant R12, 185 PSI for refrigerant R22 and 185 PSI for refrigerant R502. These temperature and pressure levels are sufficient to suppress flash gas formation in lines 22 and 23 but the conventional means of maintaining such levels by use of high compressor discharge pressures limits system efficiency.

Various means are used to maintain the temperature and pressure levels stated above. For example, FIG. 1 shows a fan unit 31 connected to sensor 17 in line 21. Controlled by sensor 17, fan unit 31 is responsive to condenser temperature or pressure and cycles on and off to regulate condenser heat dissipation. A pressure responsive bypass valve 18 in condenser output line 21 is also used to maintain pressure levels in receiver 12. Normally, valve 18 is set to enable a free flow of refrigerant from line 21*a* into line 21*b*. When the pressure at the output line of condenser 11 drops below a predetermined minimum, valve 18 operates to permit compressed refrigerant vapors from line 20 to flow through bypass line 20*a* into line 21*b*. The addition to vapor from line 20 into line 21*b* increases the pressure in receiver 12, line 22 and line 23, thereby suppressing flash gas.

The foregoing system eliminates flash gas, but is energy inefficient. First, maintaining a 95° F. condenser temperature limits compressor capacity and increases energy consumption. Although the 95° F. temperature level maintains sufficient pressure to avoid flash gas, the resultant elevated pressure in the system produces a back pressure in the condenser which increases compressor work load. The operation of bypass valve 18 also increases back pressure in the condenser. In addition, the release of hot, compressed vapor from line 20 into line 21 by valve 18 increases the refrigerant specific heat in the receiver. The added heat necessitates yet a higher pressure to control flash gas formation and reduces the cooling capacity of the refrigerant, both of which reduce efficiency.

Another approach to suppressing flash gas has been to cool the liquid refrigerant to a temperature substantially below its boiling point. As shown in FIG. 1, a subcooler unit 40 has been used in line 22 for this purpose. However, subcooler units require additional machinery and power, increasing equipment and operating cost and reducing overall operating efficiency.

Other methods for controlling the operation of refrigeration systems are disclosed in U.S. Pat. Nos. 3,742,726 to English, 4,068,494 to Kramer, 3,589,140 to Osborne and 3,988,904 to Ross. For example, Ross discloses the use of an extra compressor to increase the pressure of gaseous refrigerant in the system. The high pressure gaseous refrigerant is then used to force liquid refrigerant through various parts of the system. However, each of these systems is complex and requires extensive purchases of new equipment to retrofit existing systems. The expenses involved in the purchase and operation of these methods usually outweigh the savings in power costs.

A more recent method of controlling the formation of flash gas in the liquid line was disclosed in U.S. Pat. No. 4,599,873 by R. Hyde. This method involves the use of a magnetically coupled centrifugal pump placed in the liquid line as seen in FIG. 2. FIG. 2 shows a vapor line 114, a condenser 116, a fan unit 118, a liquid line 120, a receiver 122, a pump 124 and 125, a liquid line 126, a heat exchanger 128, a liquid line 129, a valve 130, a line 131, a control 132, an evaporator 134, a fan unit 138, and a vapor line 140. The purpose of this method is to improve system efficiency by allowing system condensing pressures and temperatures to be reduced as ambient temperatures reduce. The centrifugal pump 124 adds pressure to the liquid line 126 at the point where the liquid line exits from the condenser 116 or receiver 122 without the use of compressor horsepower. This method of using a centrifugal pump to add pressure reduces the amount of flash gas that forms in the liquid line, but does not eliminate it altogether.

Furthermore, examination of the centrifugal pump curve in FIG. 3 shows that as flow increases, the pressure added by the centrifugal pump decreases. However, as flow of refrigerant liquid through the liquid line increases the pressure drop in the liquid line increases by the square of the velocity. This combination of effects as shown in FIG. 4. causes the centrifugal pump to only reduce the formation of flash gas during certain low flow conditions, below point A in FIG. 4. As refrigerant flow increases at high load conditions and the pressure added by the centrifugal pump decreases, the formation of flash gas begins to increase again and system capacity is lost when it is needed most.

Another deficiency of the previously described centrifugal pumping method is that the centrifugal pump is located within the liquid line itself. If the centrifugal pump falls to operate properly for any reason, it becomes an obstruction to flow of refrigerant liquid seriously impairing the operation of the refrigeration system.

The most serious deficiency of the previously describe centrifugal pumping method however, is caused by the state of the refrigerant at the outlet of the condenser 116 or receiver 122. The liquid refrigerant at this location in the system is commonly at or very near the saturation point. Any vapor that forms at the inlet of the centrifugal pump due to incomplete condensation or slight drop in pressure caused by the pump suction or any other reason will cause the centrifugal pump to cavitate or vapor lock and lose prime. This renders the centrifugal pump ineffective until the system is stopped and restarted again, and is very detrimental to pump life and reliability. Due to the constantly varying conditions df operation of the refrigeration system this can occur with great regularity.

A further development pertaining the fields of mechanical air conditioning and refrigeration relating to system optimization is disclosed by U.S. Pat. No. 5,150,580 also by R. Hyde. This development, seen in FIG. 2., involves the transfer of some small amount of liquid refrigerant from the outlet of the centrifugal pump 124 in the liquid line 126 to be injected via conduit 136 into the compressor discharge line 114 by means of the added pressure of the centrifugal pump 124 in the liquid line. The purpose of injection this liquid into the discharge line is to de-superheat the compressor discharge vapors before they reach the condenser to reduce condenser pressure and thereby reduce the compressor discharge pressure. This development is said to improve system efficiency at high ambient temperatures when air conditioning systems work the hardest and system pressures are the highest.

Again, however, as system pressures increase and refrigerant flow rates increase at higher loads, the increased flow rate of refrigerant causes more pressure loss through the condenser. However, this same increased flow rate causes less pressure to be added to the liquid by the centrifugal pump 124 in the liquid line 126. Thus, less liquid is bypassed via conduit 136 into the compressor discharge line and less superheat is eliminated at the time when more reduction is needed. And at some point the pressure loss through the condenser is greater than the pressure added by the centrifugal pump and the effect is lost entirely.

Obviously, there remains a need to provide a stable pressure increase in the liquid line 126 to completely eliminate the formation of flash gas, and likewise a stable pressure increase in the liquid injection line 136 to completely de-superheat the compressor discharge vapors if the improvement in system efficiency is to be realized on a constant and reliable basis regardless of system configuration or refrigerant flow rate or vapor content.

There are several major problems associated with adding refrigerant pumps to the liquid line of refrigeration and air conditioning systems:

1. The constantly changing flow rate of the refrigerant.
2. The propensity of refrigerant to boil when it is near saturation as it usually is in these applications.

Centrifugal pumps operate well under a varying flow conditions, but not when vapor bubbles form in the liquid as a result of the refrigerant boiling. Then they tend to vapor lock, which prevents them from adding pressure. This makes them unacceptable in refrigerant pumping applications since there is a high potential for vapor bubbles to be present.

Positive displacement pumps, on the other hand, perform well, even in the presence of vapor bubbles. This makes them the better choice for use in refrigeration and air conditioning systems. Positive displacement (PD) pumps, however, provide a constant flow rate, so they must be modified to perform in varying flow rate systems.

The objectives of the present invention are to:

1) Reliably and constantly increase the pressure in the liquid line to suppress the formation of flash gas without unnecessarily maintaining a high system pressure, and without the possibility of obstructing the flow of refrigerant through the liquid line.

2) To reliably and constantly inject the correct amount of liquid into the compressor discharge line to maximize the heat transfer in the condenser.

3). To improve the operating efficiency of compression-type refrigeration and air conditioning systems in a constant, controlled and reliable basis regardless of system configuration or refrigerant flow rate.

4). To maximize the refrigeration capacity of refrigeration and air conditioning systems in a constant, controlled and reliable basis regardless of system configuration or refrigerant flow rate.

5). To economically and constantly suppress the formation of flash gas in refrigeration and air conditioning systems without impairing refrigeration capacity and efficiency regardless of system configuration or refrigerant flow rate.

6). To provide a way to inexpensively retrofit existing refrigeration systems to attain the foregoing objects on a reliable and controllable basis regardless of the system configuration or refrigerant flow rate.

7). To provide a method of automatically reducing the flow rate of the pumping apparatus to match the refrigerant flow rate in large refrigeration or air conditioning systems that have some unloading capability to match the load.

8). Further, the previous objects must be met in a way that will not be detrimental to the system in the event of failure of the installed pumping mechanism or condenser cooling mechanism.

9). Still further, the above objects must be reliably met regardless of the presence of some vapor in the liquid at the inlet of the pumping arrangement since the liquid is at or near saturation.

10). To assure that pressure added to the refrigerant is accomplished accurately and constantly during the widely varying flow conditions of refrigerant systems.

11). To virtually eliminate vibration in a positive displacement pump arrangement and avoid cavitation in the liquid line.

12). To allow a positive displacement pump to run substantially unloaded much of the time so that pump uses just a fraction of the power it would use running at full speed.

13). Moreover, the above objects must be met in a way that can be adjusted to satisfy a majority of the wide range of system configurations found in the field.

This invention provides for the refrigeration or air conditioning system to be operated in a way which maximizes energy efficiency and suppresses flash gas formation regardless of system configuration or refrigerant flow rate.

The foregoing and other objects, features, and advantages of the invention will become more readily apparent from the following description of a preferred embodiment, which proceeds with reference to the figures.

SUMMARY OF THE INVENTION

The invention entails the use of a variable speed drive, positive displacement pump magnetically coupled to a drive motor located in a conduit arrangement that is parallel to the liquid line of the refrigeration system as in FIG. 5 This parallel conduit arrangement also includes a pressure regulating valve that will regulate the amount of pressure added to the liquid line by the parallel pump and piping arrangement. In addition, a check valve is located in the liquid line to maintain the pressure differential added to the liquid line. This parallel piping arrangement is desirable in order to allow a constant, pre-determined pressure to be added to the liquid line regardless of variations in flow rate of the liquid refrigerant. In addition, the parallel piping arrangement allows the system to operate without liquid line obstruction in the event of pump failure.

The present invention involves the use of a controlled variable speed drive on the pump motor so the flow rate through the pump will more closely match the variable system flow rate. This drive may be configured for continuously variable speed or a discrete plurality of speeds (multiple speed). The term "variable speed drive" in this disclosure means either option.

In various embodiments the pump speed can be controlled, continuously or discretely by: the amperage draw on a rack of compressors, a signal from a pressure sensor in the liquid line, a signal combined from several sensors indicating the pressure differential across the pump, a signal from a flow sensor in the liquid line at the outlet of the liquid receiver or condenser, a signal from a pressure or flow sensing device in a bypass line to vary pump speed to limit the flow of refrigerant through the bypass, a signal from a vapor sensing device in the liquid line to vary the pump speed sufficiently to eliminate the vapor, a signal from the refrigeration rack controllers so that pump speed is varied according to any number of existing inputs, a signal obtained by measuring the "conditions " (amount of subcooling) of the refrigerant at the inlet to the expansion valve, or a signal from a superheat sensor at the outlet of the evaporator.

Further, a liquid injection line may be added between the outlet of the pump and the compressor discharge line for the purpose of de-superheating the compressor discharge vapors. The pressure boost provided by the pump assures a constant flow of liquid refrigerant to the compressor discharge line. Also, a thermostatic expansion valve is added at the end of the injection line. Then, a sensing bulb connected to the thermostatic expansion valve but affixed to the compressor discharge line downstream of the injection point is used to measure the superheat and control the operation of the thermostatic expansion valve. In this way the superheat is maximized.

The use of the combination of a positive displacement pump in parallel with a pressure differential valve is essential to this invention. The use of the variable speed drive to control the rate of flow through the pump is also essential in systems where a higher level of control is required. The addition of the liquid line and thermostatic expansion line is optional.

The positive displacement pump type of pump is essential for two significant reasons, neither one of which can be accomplished with a centrifugal pump.

1. To provide a constant increment of pressure boost over a wide range of flow rates.

2. To provide this increment of pressure boost regardless of the presence of some vapor at the inlet to the pump.

The pressure differential valve is essential in order to limit the pressure boost provided by the pump to a predetermined value.

DETAILED DESCRIPTION OF THE PREFERRED EMBODIMENT

Figure 1:
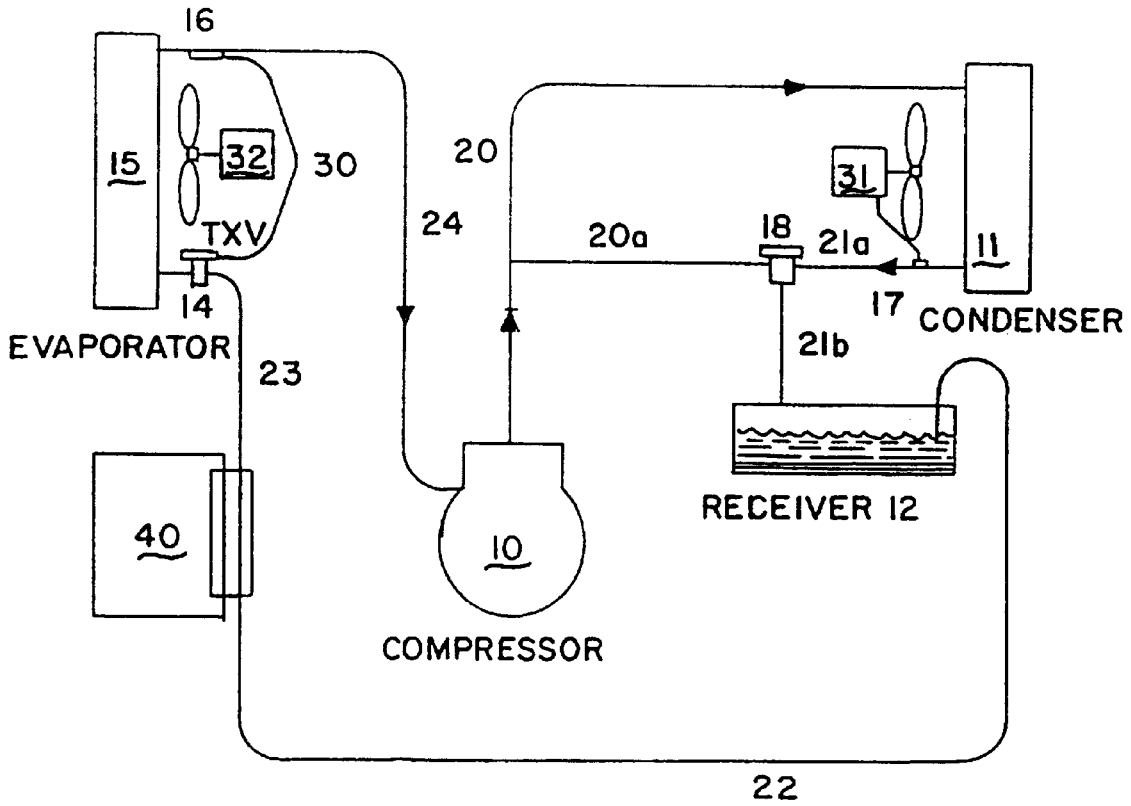
Fig. 1 (PRIOR ART)
FIG. 1 is a schematic diagram of a typical refrigeration system, as previously described.
Figure 2:
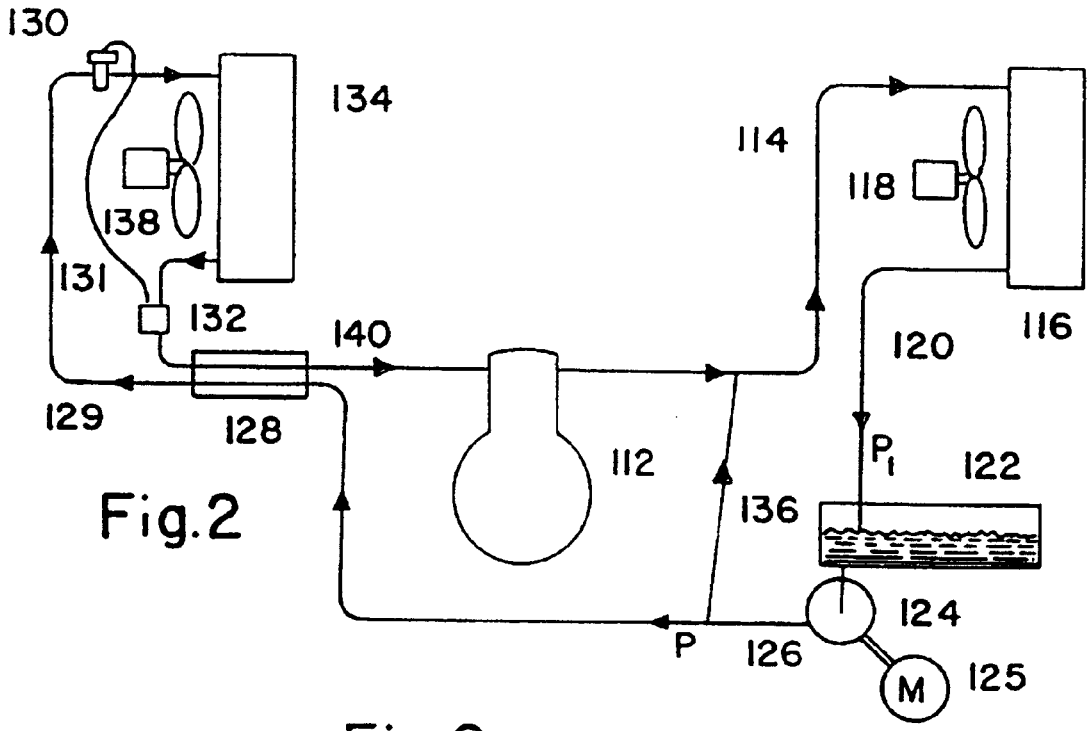
Fig.2 (PRIOR ART)
FIG. 2 is a schematic diagram of a refrigeration system including the prior art as previously described, including the liquid injection for de-superheating.
Figure 3:
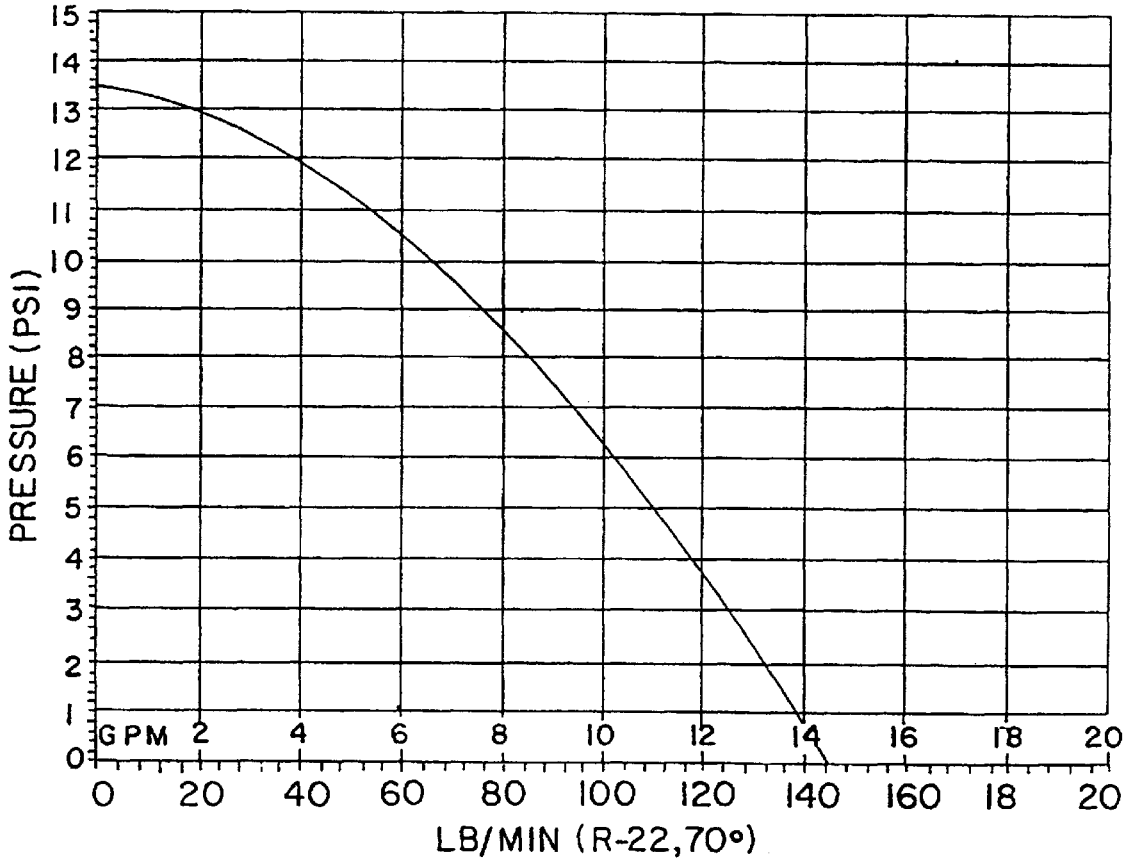
FIG. 3 is a diagram of a typical centrifugal pump curve showing pressure added vs. flow rate.
Figure 4:
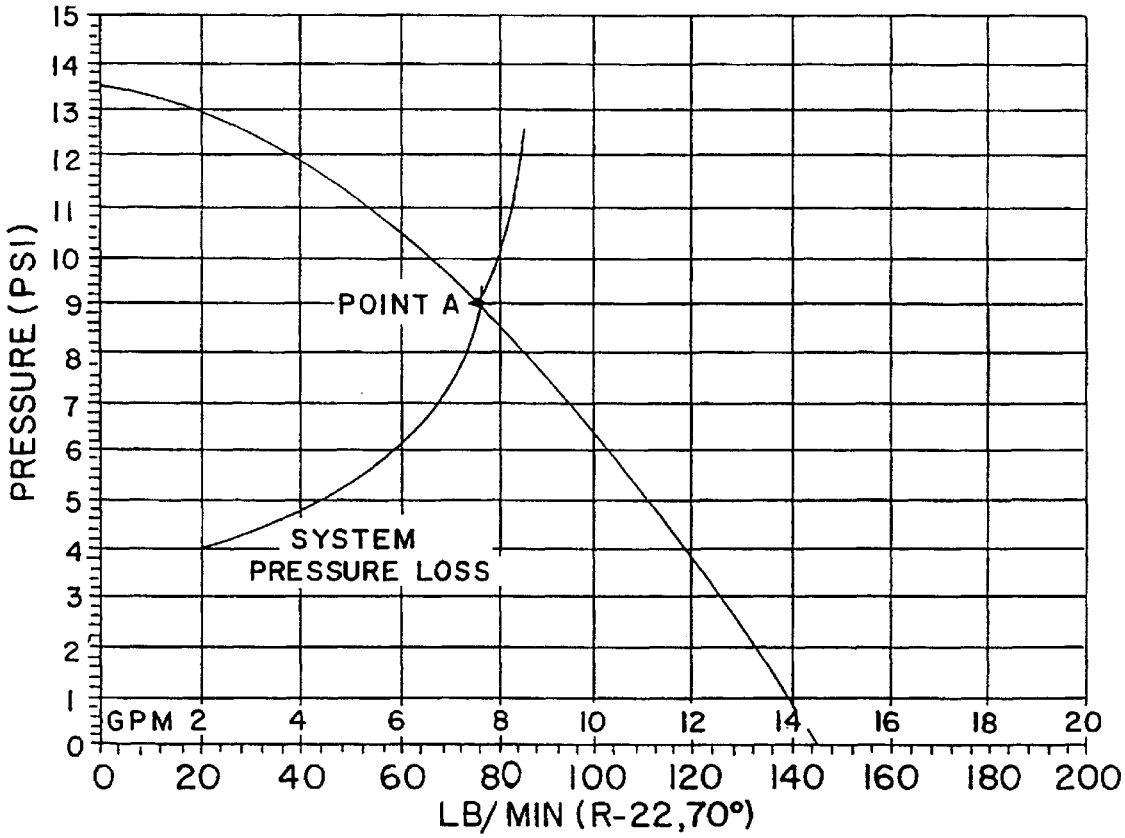
FIG. 4 is a diagram of pressure loss through a piping system vs. flow rate with the centrifugal pump curve superimposed over it.
Figure 5:
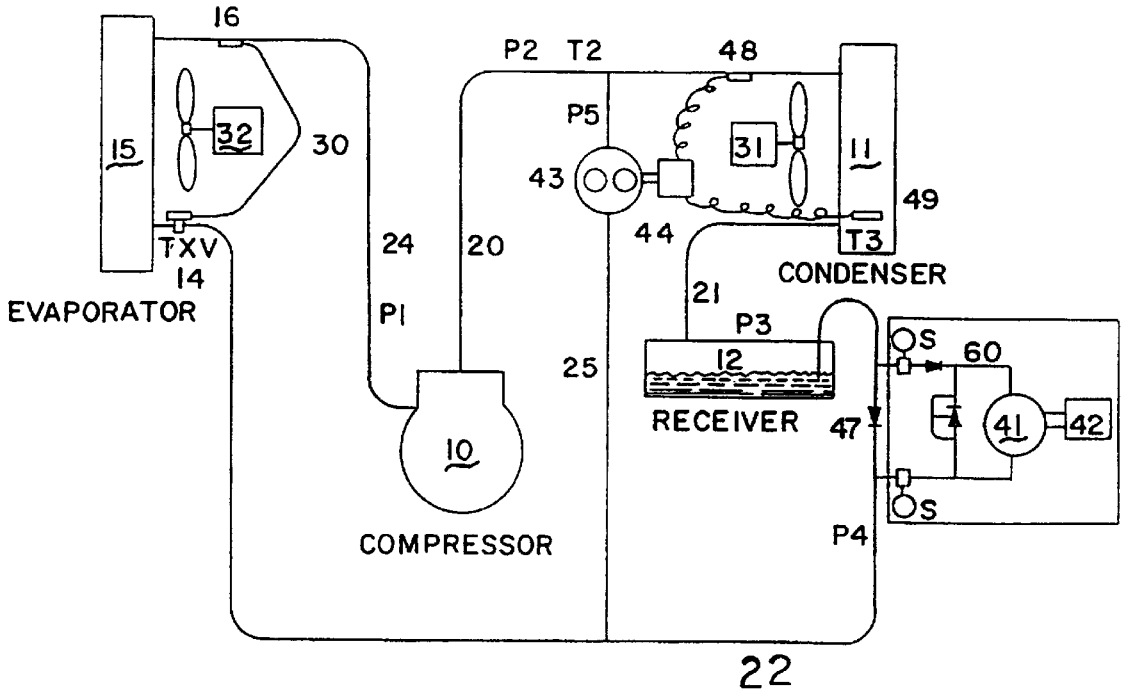
FIG. 5 is a schematic diagram of a refrigeration system including an essential precursor to the present invention.

Referring now to FIG. 5, a closed circuit compression-type refrigeration system includes a compressor 10, a condenser 11, an optional receiver 12, an expansion valve 14 and an evaporator 15 connected in series by conduits defining a closed-loop refrigerant circuit. Refrigerant gas is compressed by compressor unit 10, and routed through discharge line 20 into condenser 11. A fan 31 facilitates heat dissipation from condenser 11. Another fan 32 aids evaporation of the liquid refrigerant in evaporator 15. The compressor 10 receives warm refrigerant vapor at pressure P1 and compresses and raises its pressure to a higher pressure P2. The condenser cools the compressed refrigerant gases and condenses the gases to a liquid at a reduced pressure P3. From condenser 11, the liquefied refrigerant flows through line 21 into receiver 12 in cases where there is currently a receiver in the system. If there is no receiver in the system the condensed refrigerant flows directly into the liquid line 22. Receiver 12 in turn discharges liquid refrigerant into liquid line 22.

Figure 6:
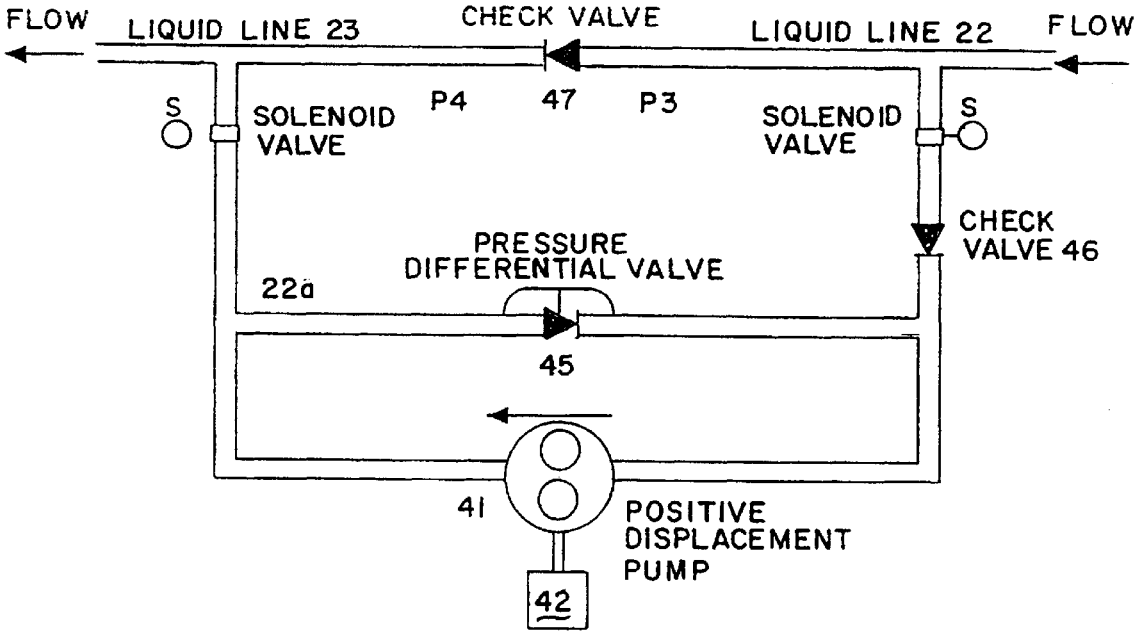
FIG. 6 is a more detailed diagram of the parallel piping arrangement with positive displacement pump, pressure differential regulating valve and check valves of the precursor to the present invention.

FIG. 6 shows a positive displacement pump 41, driven by electric motor 42 magnetically coupled to the pump head is positioned in conduit arrangement 60 parallel to the liquid line 22 at the outlet of the receiver or condenser to pressurize the liquid refrigerant in the line to an increased pressure P4. This parallel piping arrangement 60 also includes the pressure differential regulating valve 45 and a check valve 46 arranged as shown in FIG. 6 to provide for a constant added pressure (P4–P3) regardless of refrigerant flow rate or vapor content. A check valve 47 is added to the liquid line 22 to maintain the pressure differential between line 22 and line 23 (see FIG. 7). An adjustable pressure regulating valve 45 can also be used to more accurately match the pressure differential be required or to facilitate changes that may be needed in the pressure differential added. The pressure differential of the regulating valve 45 (FIG. 6) determines the amount of pressure that is added to the system. Different amounts of pressure can be added to the liquid line 22 as necessary for each different system configuration by using different pressure differential valves or by adjusting the valve to a specific pressure as needed. As the flow rate of the system varies in conduit 22, more or less refrigerant flows through parallel conduit 22*a* (FIG. 6) and pressure regulating valve 45 so the refrigerant flow into and out of the parallel piping arrangement 60 always matches the flow rate through conduit 22 and 23 and the pressure differential (P4–P3) remains constant.

Figure 7:
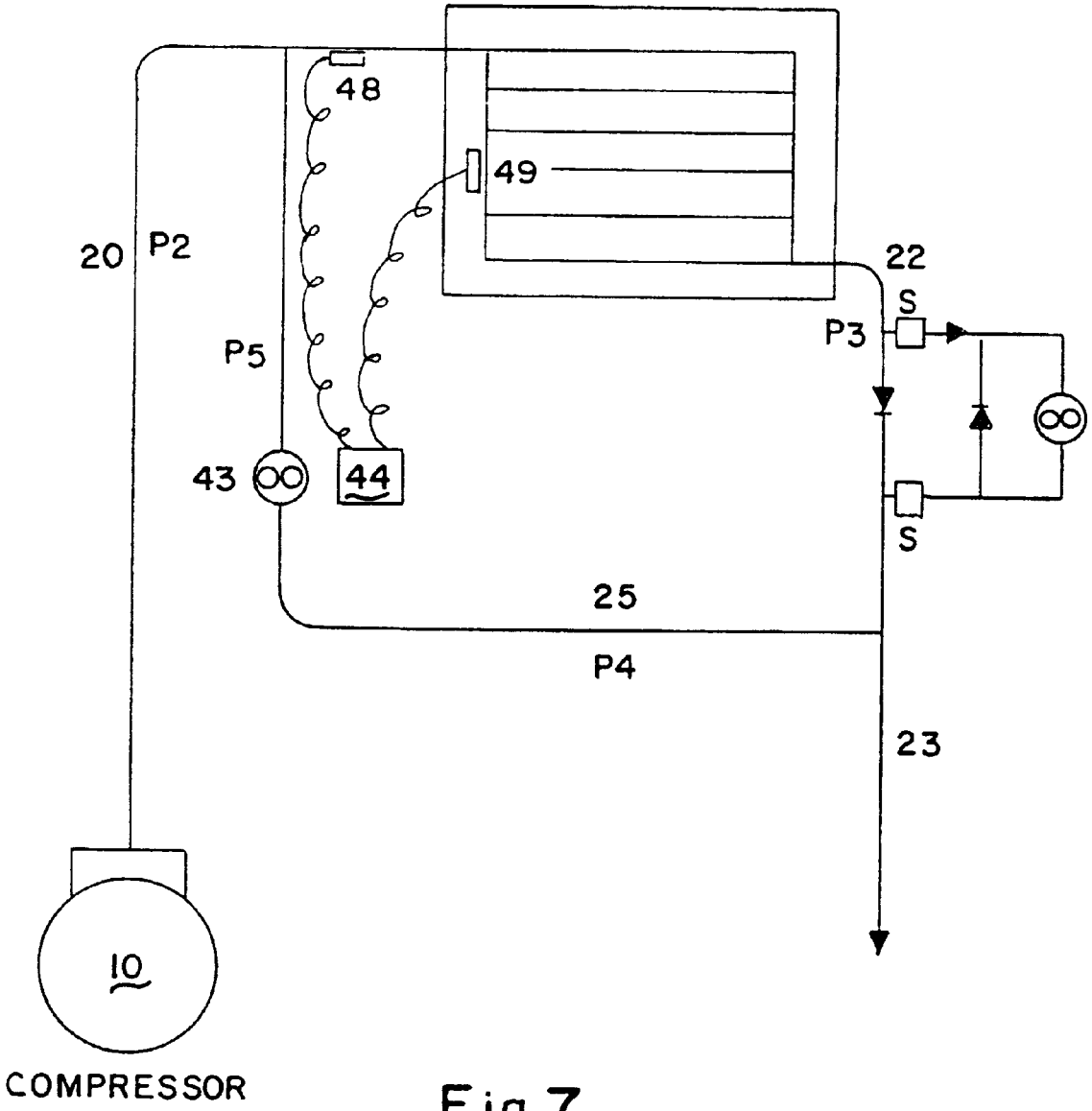
FIG. 7 is a more detailed diagram of the preferred method of adding pressure to the liquid injection line.

From parallel piping arrangement 60, the liquid refrigerant flows into the liquid line 23 (FIG. 7). Some of the liquid refrigerant flows through conduit 25 and thermostatic expansion valve 81 into the compressor discharge line to de-superheat the compressor discharge vapor. The thermostatic expansion valve is controlled by bulb 48 which senses the temperature of the superheated vapor.

The remainder of the liquid refrigerant from the parallel piping arrangement 60 (FIG. 5) flows through the line and through an optional counter-current heat exchanger (not shown) to thermostatic expansion valve 14. Thermostatic expansion valve 14 expands the liquid refrigerant into evaporator 15 and reduces the refrigerant pressure to near P1. Refrigerant flow through valve 14 is controlled by temperature sensing bulb 16 positioned in line 24 at the output of evaporator 15. A capillary tube 30 connects sensing bulb 16 to valve 14 to control the rate of refrigerant flow through valve 14 to match the load at the evaporator 15. The expanded refrigerant passes through evaporator 15 which, aided by fan 32, absorbs heat from the area being cooled. The expanded, warmed vapor is returned at pressure P1 through line 24 to compressor 10, and the cycle is repeated.

Pump 41 and pressure regulating piping arrangement 60 is preferably located as close to receiver 12 or the outlet of condenser 11 as possible, and may be easily installed in existing systems without extensive purchases of new equipment. Pump 41 must be of sufficient capacity to increase liquid refrigerant pressure P3 by whatever pressure is necessary to eliminate the formation of flash gas in the liquid line 23 (FIG. 7). The pump must also be capable of adding a constant pressure to the liquid line regardless of the presence of some vapor in the incoming liquid refrigerant in line 22. A positive displacement pump and pressure regulating valve located in a parallel piping arrangement 60 most effectively, economically and reliably provides this capability.

Pump 41 must also be capable of adding a constant pressure to the liquid line under conditions of variable refrigerant discharge rates from valve 14, including conditions in which valve 14 is closed.

Figure 8:
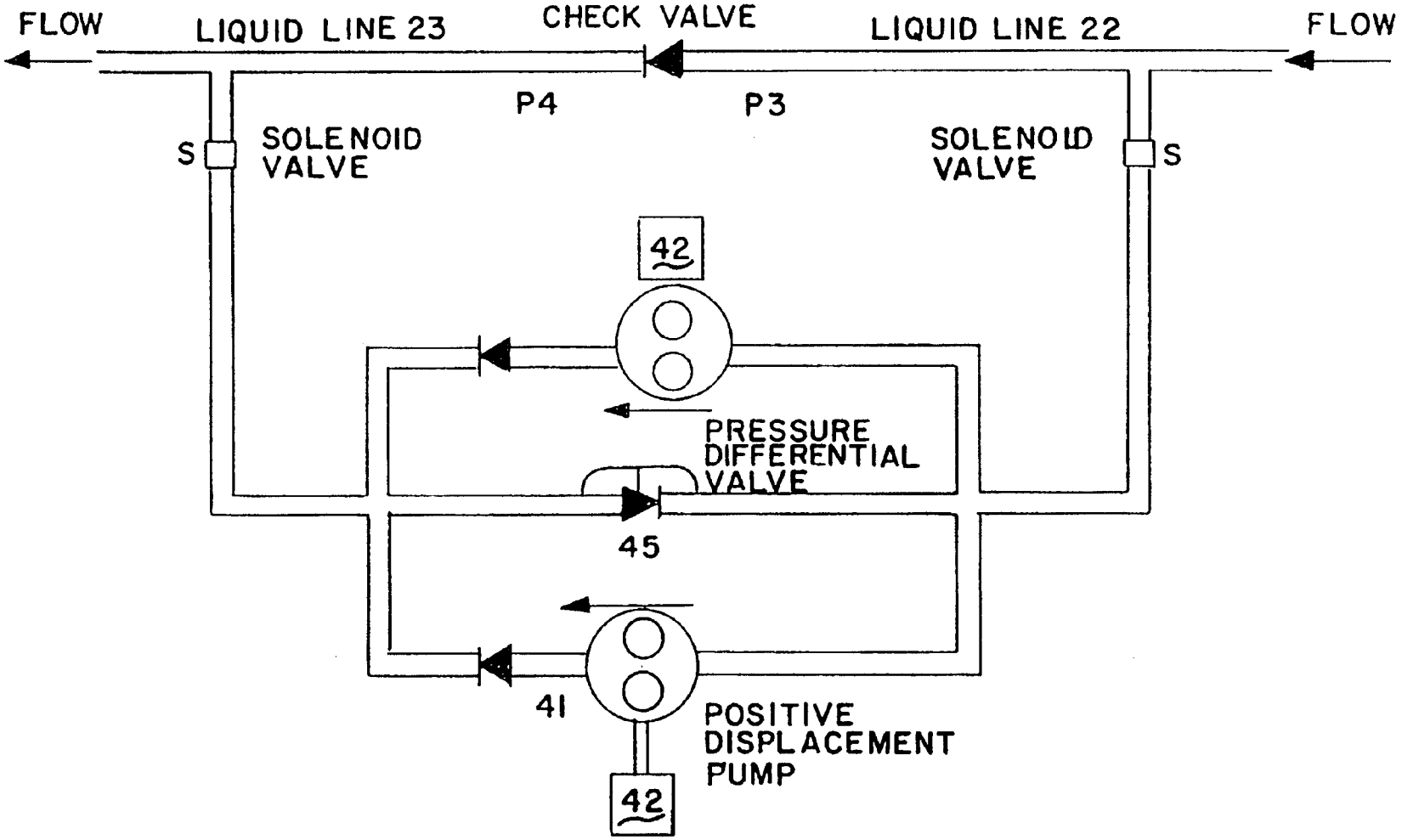
FIG. 8 is a diagram of the duplex pumping arrangement used to match changing refrigerant flow rate in larger systems with unloading capabilities.

In systems where the refrigerant flow rate varies significantly, the pumping arrangement must be able to vary its flow rate by a similar amount. In these cases, a duplex pumping arrangement, FIG. 8, may be used. The duplex pumping arrangement consists of two pumps piped in parallel each with either a single speed, two speed or variable speed motor and a control mechanism capable of adjusting the speed of one or both pumps to match the flow rate of the refrigerant in the refrigeration circuit. This duplex pumping arrangement is typically used in systems that have multiple compressors or compressors with the capability of unloading to significantly reduce the refrigerant flow rate. The duplex pumping arrangement controls tie into the system controls to adjust the pump or pumps speed to match the compressor loading thereby matching the refrigerant flow rate.

There are several possible modifications to the installation of the positive displacement pumps which allow us to most efficiently take advantage of their superior performance with saturated liquids.

1. A bypass with a pressure differential check valve has been added to insure that a predetermined pressure differential exists across the pump, and that there is a path for excess flow, and
2. A variable speed drive has been installed on the positive displacement pump motor so the flow rate through the pump will more closely match the system flow rate.

In some large systems, refrigeration system racks are comprised of several compressors manifolded together and sized to handle the maximum load of the system. The compressors cycle off and on individually to match the varying system load. At any given time the system load and resulting refrigerant flow rate may be at its maximum or none, or anywhere in between. Since, the positive displacement pump flow rate must also be designed for maximum load of the system, under all but the most loaded conditions, the positive displacement pump will be oversized.

Figure 11:
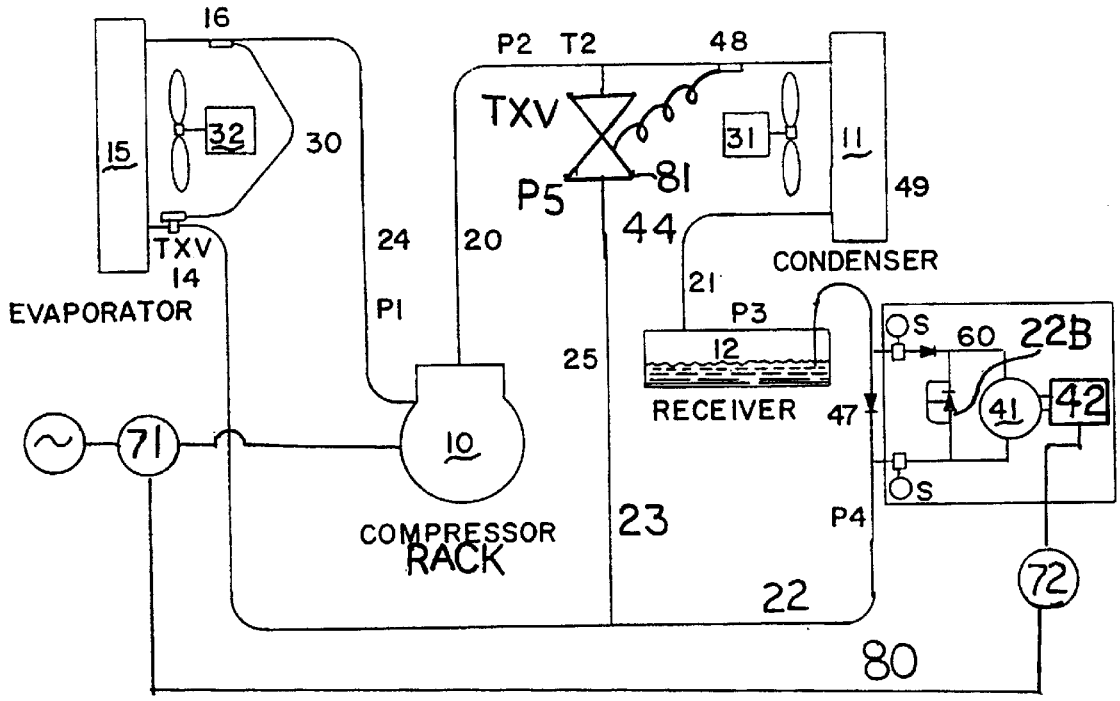
FIG. 11 show the use of a variable speed drive controlled by current being supplied to the compressor rack.

The theory behind the application of a variable speed drive to a positive displacement pump is that by controlling the speed of the motor driving the positive displacement pump, the flow rate will vary directly with it. This concept has been tested on a large supermarket refrigeration system. In order to vary the positive displacement pump flow rate with the flow rate of the system, an amperage sensor was placed onto the main electrical feed to the rack between the power source and the compressor rack. The system, and the refrigerant flow rate increases and decreases with the load in a similar fashion. The amperage sensor sensed the current draw of the system and produced a variable signal output based on this current draw. This variable signal output was sent to the signal input of the variable speed drive thereby varying the speed of the drive and pump motor based on the current use of the rack (FIG. 11).

Using this method, we found that the advantages of using the positive displacement pump could be fully realized.

1. The pressure added to the refrigerant was accurate and constant during the widely varying flow conditions of the refrigeration system.
2. Much less refrigerant was bypassed through the overflow valve. This virtually eliminated vibration in the positive displacement pump and cavitation in the liquid line.
3. Since the positive displacement pump ran substantially unloaded much of the time, the pump itself used just a fraction of the power that it was using when it was running at full speed.

It should be noted that a number of alternative input devices could be used to control the speed of the motor, and therefore the refrigeration flow.

1. A pressure sensing device could be used to provide a constant liquid line pressure.
2. Several sensing devices could be used to provide a constant pressure differential across the pump (FIG. 12).
3. A pressure or flow sensing device in the bypass line could be used to vary the speed of the pump to limit the flow of refrigerant through the bypass.
4. A vapor sensing device in the liquid line could be used to vary the speed of the pump sufficiently to eliminate the vapor.
5. The variable speed drive could be tied into refrigeration rack controllers which would vary the speed according to any number of existing inputs.

In addition to these, there are a great many other devices and means of controlling the speed of the pump and associated pressure boosts and flow rates.

Operation

Referring to FIG. 5, compressor 10 compresses the refrigerant vapor which then passes through discharge line 20 to condenser 11. In the condenser 11, at pressure P2, heat is removed and the vapor is liquefied by use of ambient air or water flow across the heat exchanger. At condenser 11, temperature and pressure levels are allowed to fluctuate with ambient air temperatures in an air-cooled system, or with water temperatures in a water-cooled system to a minimum condensing pressure/temperature that has previously been set at about 95° F. This previously set minimum condensing temperature has been necessary to prevent the formation of flash gas in the liquid line 22. The previously set minimum was maintained by reducing air or water flow across the heat exchanger of condenser II to reduce heat transfer from the condenser. Further decreasing the condensing temperatures increase system efficiency in two ways: 1) The lower pressure differential of the compressor 10 increases the compressor volumetric efficiency according to the formula $V_e=1+C-C^*(V_1/V_2)$ where $V_e$ is volumetric efficiency, C is the clearance ratio of the compressor, $V_1$ is the specific volume of the refrigerant vapor at the beginning of compression, $V_2$ is the specific volume of the refrigerant vapor at the end of compression, and 2) The lower liquid refrigerant temperature at the outlet of the condenser results in a greater cooling effect in the evaporator.

The negative effect of reducing condensing temperatures below this previously set minimum has been the formation of flash gas in the liquid line 23 (FG. 7), which when passed through expansion valve 14 reduced the net refrigeration effect of the evaporator 15. The net result was a reduction of energy consumption per unit time by the compressor, but a simultaneous reduction capacity of the system causing an increase in compressor run time resulting in no net energy savings.

When the refrigeration or air conditioning system is modified with the present invention as in FIG. 5, the minimum condensing temperature and pressure can be reduced significantly without the loss of capacity mentioned above due to the pressure added to the liquid line by the pump 41 and parallel piping arrangement. As the ambient air temperature or water temperature used to cool the condenser becomes lower, the efficiency of the compressor improves, and the capacity of the evaporator increases, since no flash gas has been allowed to form in the liquid line. This is most beneficial with refrigeration systems that operate year around and can take advantage of the cooler ambient temperatures.

As ambient air temperature or cooling water temperature increases the condensing temperature and pressure of the refrigeration or air conditioning system also increases and efficiency is reduced. In order to improve efficiency at these higher ambient conditions when air conditioning and refrigeration systems are at or near maximum capacity, liquid refrigerant is bypassed from the liquid line 23 (FIG. 7) into the compressor discharge line 20. Since there is some amount of pressure lost as the refrigerant passes through the condenser 11, making condenser exit pressure P3 lower than entrance pressure P2, a pressure boost is needed to insure flow of liquid from the liquid line 23 into the discharge line 20. Pump 41 provides this pressure boost.

An alternative method is to use a separate positive displacement pump 43, driven by a variable speed drive, controlled by the temperature differential between the superheated compressor discharge vapor temperature 12 and the condensing temperature T3. As the temperature differential becomes greater, the variable speed drive would cause the positive displacement pump to pump more liquid into the discharge line 20 to decrease the superheat. When the superheat temperature and the condensing temperature were the same, the refrigerant vapor entering the condenser would be at the saturation point and the speed of the positive displacement pump would stabilize to a pre-set speed to maintain the condition.

This method of superheat suppression insures that the refrigerant vapor is entering the condenser at saturation resulting in the optimum conditions for heat transfer thereby optimizing the efficiency of the condenser. This portion of the invention is most beneficial at higher ambient temperature.

Figure 9:
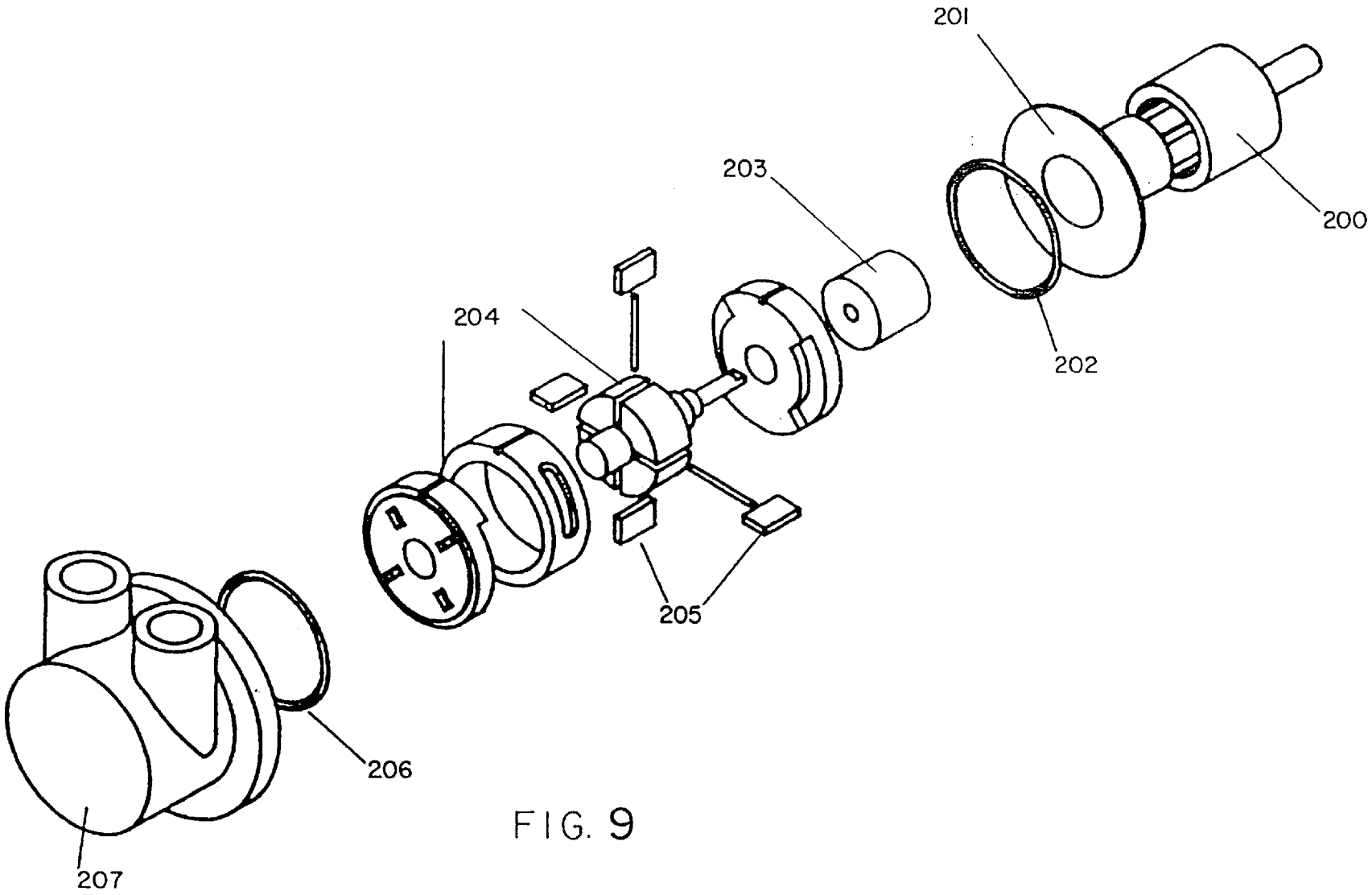
FIG. 9 is a blown up depiction of a preferred embodiment of the pump(s) of the present invention.

Referring to FIG. 9, the pump(s) of the present invention consists of an outer driving magnet 200, a stationary cup 201, and an O-ring seal 202. The pump further includes an inner driven magnet 203, a rotor assembly 204 and vanes 205. The pump further includes an O-ring seal 206 and brass head 207.

Taken together, both parts of the invention improve system performance and efficiency over the full range of operating conditions and temperatures.

The use of magnetically-coupled rotary-vane pumps as positive displacement pumps for pumping refrigerants has been found to be startlingly effective and they have been found to exhibit a surprisingly long life. Once the vanes are worn to the extent that they are properly seated and sealed, subsequent wear is almost negligible. This discovery has resulted in very effective use of these magnetically-coupled rotary-vane pumps as positive displacement pumps for pumping refrigerants in non-compressor-type refrigeration cycles. This application is particularly effective when a compressor-type refrigeration cycle (preferably with the help of the present invention) is used to store refrigeration, for example, in the form of ice, during low energy cost periods and then the compressor is turned off during peak energy cost periods. During the peak period, the magnetically-coupled rotary-vane pump of the present invention (ideally the same pump used to increase the efficiency of the compressor cycle) is used to circulate the same refrigerant through the ice, through the same conduits, and through the same cooling coils (evaporator), to cool the conditioned space during peak energy cost periods.

Another aspect of the present invention is the use of staring torque control means for the positive displacement pump. Typically, when a positive displacement pump is placed into the liquid line of an air conditioning or refrigeration system, the electric motor driving it is energized when the compressor is energized. This creates two problems when the pump head is full of refrigerant upon start-up, as it is normally the case. First, excessive torque is required to bring the pump head up to speed while it is adding pressure to the liquid. Second, the rapid acceleration of the pump rotor will cause temporary, but significant, cavitation that may damage the pump.

The solution to both problems is to ramp the motor and pump up to operating speed slowly. This can be accomplished by using a device called a "soft starter". This device will bring the motor up to full speed over a period of 1 or more seconds, depending on its design.

Upon normal start-up, a standard electric motor will go from 0 R.P.M. to its full speed of 3450 R.P.M. in less than 1 second. This causes excessive torque requirements and cavitation when such a motor is coupled to a positive displacement pump that is full of a liquid near saturation. If the acceleration rate of the motor and pump head is slowed down so that it comes up to speed in preferably between 2 and 8 seconds, for example, the excessive torque and cavitation problems are avoided.

The variation in start-up acceleration can be accomplished by several means: 1. using an induction coil in series with the electric motor, or 2. redesigning the motor windings to give less start-up torque, therefore slower starting speed, or 3. installing a separate "soft start" electronic component to a standard motor that varies the voltage to the motor.

The type of pump is important, contrary to what the prior art teaches, and it must be a positive displacement type contrary to what is disclosed in prior art systems.

In order to insure stable and therefore optimal system operation, the pressure valve must be a pressure differential valve not a pressure limiting valve as shown in prior art. The purpose of the added pressure is only to overcome the pressure loss in the liquid line to prevent the formation of vapor in the liquid line. The pressure differential valve, set at a constant, predetermined pressure differential accomplishes this without the use of excess pumping energy. The pressure limiting valve in a prior method, limits the reduction of pressure in the liquid line. This method holds excess pressure in the liquid line during periods of low condensing pressure, but does nothing to prevent vapor formation in the liquid line during periods of higher condensing pressure. The purpose of the prior pressure limiting valve method is to maintain a high pressure differential across the metering device at the inlet to the evaporator. The purpose of the pressure differential valve of the present, improved method is to maintain optimum metering device capacity by constantly adding the predetermined pressure necessary to prevent the formation of vapor in the liquid line during all periods of operation.

To further optimize system performance a variable speed drive is used to vary the flow rate of the positive displacement pump while maintaining a constant pressure differential.

Three factors effect the capacity of the system refrigerant metering device and therefore the capacity of the system; 1) Quality of liquid refrigerant at the inlet to the metering device. ie.: If any vapor is present in the liquid refrigerant entering the metering device, the system capacity is reduced by the percent of vapor present, 2) Temperature of the refrigerant at the inlet to the metering device. ie: The lower the temperature of the refrigerant, the higher the capacity of the metering device, and 3) The pressure differential across the metering device. ie: The lower the pressure differential across the metering device, the lower its capacity.

In order to optimize system performance, all three factors must be simultaneously and constantly controlled.

Figure 10:
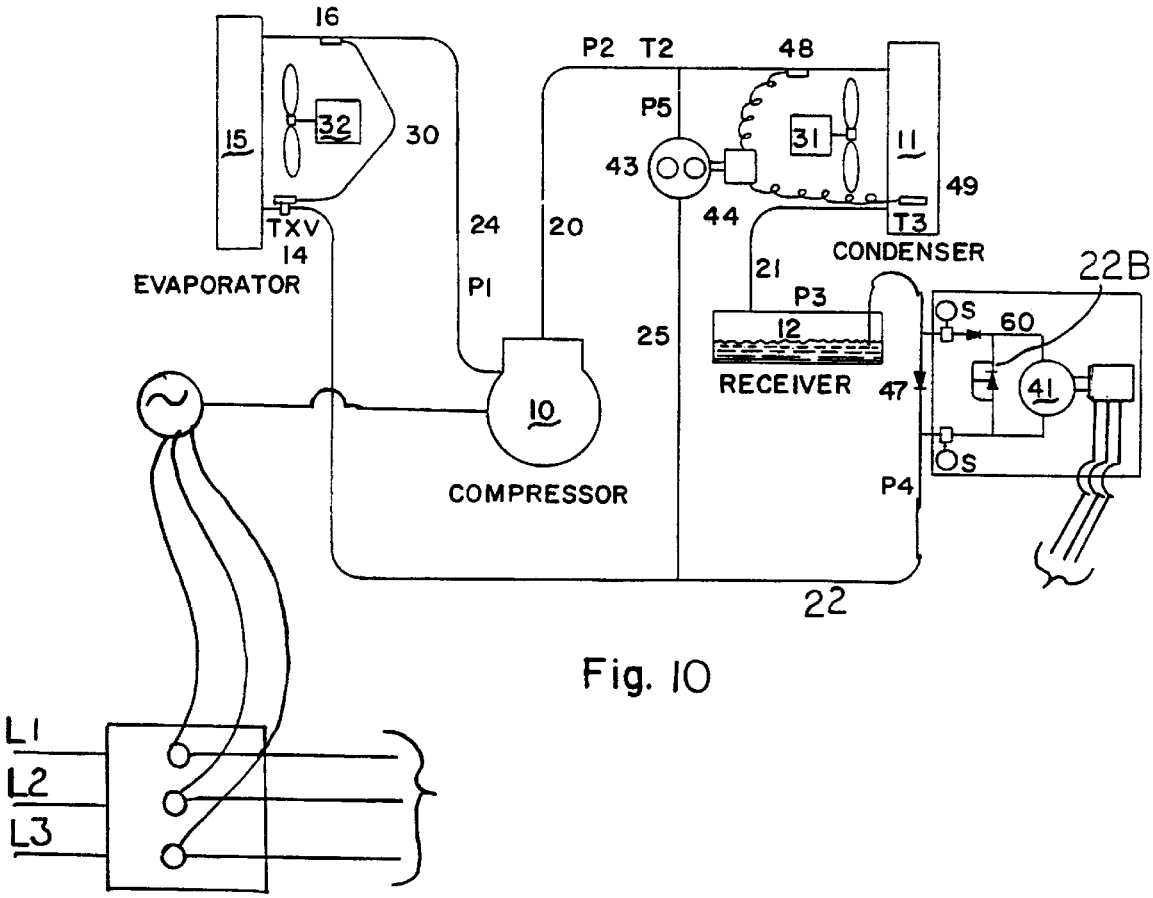
FIG. 10 shows an earlier development with a fixed speed positive displacement pump with a bypass line with pressure differential valve.

1. The use of a non-centrifugal type of pump, preferably a positive displacement type of pump, is necessary in the scope of the current invention to provide a constant, predetermined increment of pressure to the liquid refrigerant in the liquid line 22. In refrigeration or air conditioning systems, the flow rate of the refrigerant within the system piping varies continuously as the cooling load on the system varies. In order to provide a constant increment of pressure regardless of the system flow rate, a positive displacement pump must be used in conjunction with a bypass line (22B) with a pressure differential valve as shown in FIG. 10. The positive displacement pump provides a fixed flow rate that is higher than the flow rate of the system. The bypass line provides a path for the difference in flow between the constantly varying system flow rate and the fixed pump flow rate. In that way, the flow rate of refrigerant into and out of the bypass arrangement is always exactly matching the flow rate of the system, while the flow rate of the refrigerant through the positive displacement pump and the pressure added by the pump remain constant.

2. A pressure differential valve is used in the bypass line 22B to provide the constant increment of pressure necessary to satisfy the refrigerant metering device.

The temperature and pressure of the refrigerant in the condenser vary together as the refrigerant is condensing from a vapor to a liquid. As the temperature of the condensing medium is reduced, the temperature and pressure of the refrigerant being condensed to a liquid can be reduced. The result is, as the condensed refrigerant liquid temperature is reduced, its pressure is also reduced. Since the capacity of the metering device increases with a reduction in liquid temperature and decreases with a reduction in liquid pressure, the net capacity of the refrigerant metering device will remain relatively constant as long as the temperature and pressure differential are reduced together, and there is no vapor present in the liquid line or at the inlet to the metering device.

The pressure differential valve allows this reduction in temperature and pressure to occur while the pump adds the minimum constant increment of pressure necessary to prevent vapor form forming in the liquid line. The addition of the lowest constant increment of pressure necessary instead of adding excess pressure, up to the limit of the pressure regulating valve, allows for the optimal system operation to be maintained without the use of excess energy that would be required to add the excess pressure up to the limit of the pressure regulating valve.

FIG. 10

Shows the processor to the present invention with constant speed drive to provide steady flow rate and pressure increment with the difference in flow rates between pump flow rate and system flow rate being bypassed through line 22B. This method allows for a constant, predetermined increment of pressure to be added while the flow rate through the bypass arrangement exactly matches the varying system flow rate through line 22. This method would be used in refrigeration and air conditioning systems where the variation in refrigerant flow rate is not great and the compressor cycles on and off to match the system load. In this method, the pump is energized whenever the compressor is energized.

FIG. 11

In many larger refrigeration and air conditioning systems, the system is designed to have the capacity necessary to satisfy the maximum load required, but the actual load on the system is significantly lower than this maximum during a majority of its operating hours. By the same token, the refrigerant pumping system must be sized for the maximum refrigerant flow rate, but the actual refrigerant flow rate is significantly lower than this maximum during most of its operating hours.

In these larger refrigeration and air conditioning systems, the refrigerant flow rate is varied while the compressor or compressors remain energized. This is done by either using multiple compressors that cycle on and off as needed to match the load on the system, or by using a single compressor with several cylinders that are activated or deactivated as needed to match the load on the system. In systems such as these, a variable speed drive is used to drive the positive displacement pump. The speed of the pump motor, and therefore the flow rate of the pump can be regulated by some signal from the system so the flow rate provided by the pump more closely matches the flow rate of the system.

The purpose of this invention is to optimize the efficiency of the operation of the standard refrigeration cycle. Likewise, the purpose of the variable speed drive is to optimize the efficiency of the operation of the refrigerant pump. Optimal pump operation is that which consumes the least amount of energy necessary to add the predetermined increment of pressure to the liquid line. The point of "least amount of energy necessary" occurs just as the pressure differential check valve is in the bypass line begins to open. Just before this point, the pressure added by the pump is not as high as the predetermined set point of the pressure regulating check valve. Just after this point, liquid begins to flow through the bypass and is recirculated by the pump requiring more work to be done by the pump than is necessary. Ideally then, the speed of the pump should be varied with the refrigerant flow rate to just match the flow required to start to open the pressure differential valve in the bypass line, and no more.

The preferred method of varying the flow rate of the positive displacement pump to more closely match the system flow rate in order to minimize the excess flow through the bypass line 22B in systems where the compressor or compressors operate continuously, and some means of compressor unloading occurs, is shown in FIG. 11. The flow rate provided by a positive displacement pump varies directly with the rotational speed of the pumping mechanism. Therefore, if the speed of the motor driving the pump is varied, the flow rate provided by the positive displacement pump can be varied at a predetermined rate.

In the preferred method shown in FIG. 11, an electrical current sensor (71) is attached to the wires that supply the refrigeration or air conditioning system compressor or compressors (10). As the load on the system compressors varies, the current required by the compressors varies. This variation in current is measured and a variable output signal that varies as the system current use changes is provided by the current sensor. This variable output signal is fed through wire 80 to the controls of a variable speed drive (72) attached to the pump motor. As the current required by the compressors varies, the signal output from the sensor changes the speed of the motor driving the pump thereby causing the flow rate of the pump to vary with the load on the compressors.

For example, the maximum current required by a refrigeration system at full load is 100 amps, and varies with load down to 0 amps when the system is off. A current sensor that generates a 4 to 20 milliamp control signal is attached to the electrical wires that energize the refrigeration system. If the system is operating at full load and is drawing 100 amps, the amperage sensor generates a 20 milliamp signal output. If the system is off and is drawing 0 amps, the amperage sensor generates a 4 milliamp output signal. This signal is fed by means of a control wire to the control input of a variable speed drive controller that controls the speed of the pump. If the variable speed drive control is fed 20 milliamps, the pump operates at full speed. If the variable speed drive control is fed 4 milliamps, the pump will not operate. The speed of the pump then varies linearly with the 4 to 20 milliamp signal to match the load on the compressors and therefore the refrigerant flow rate.

FIG. 12

Figure 12:
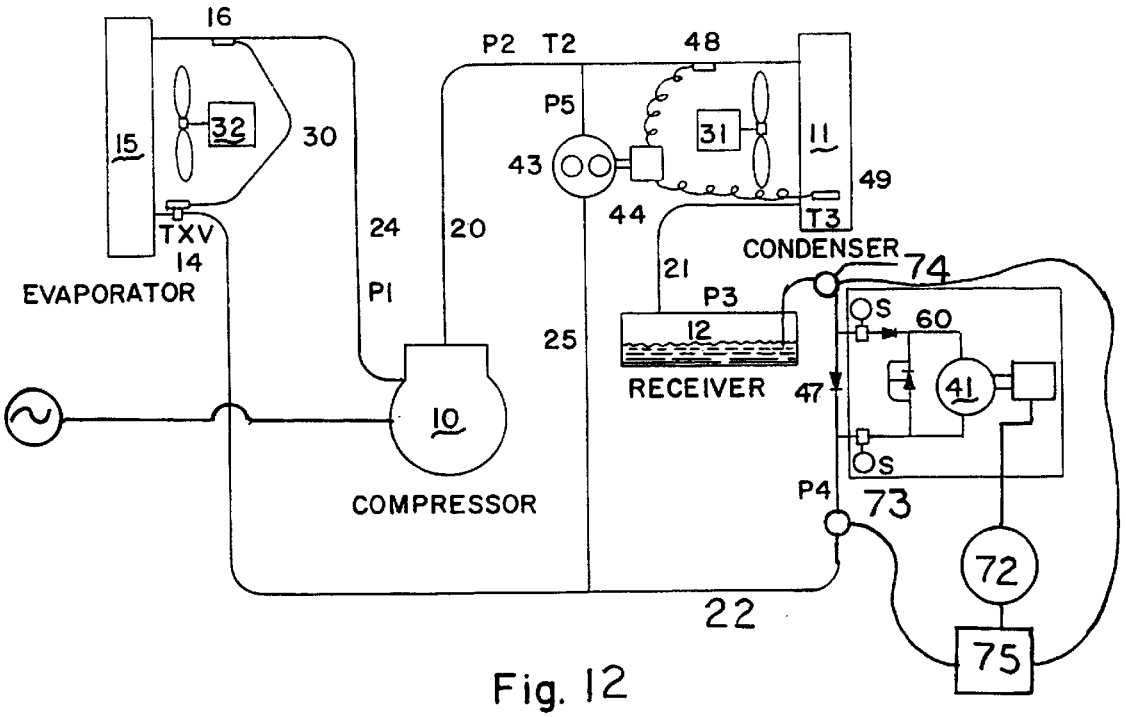
FIG. 12 shows a variable speed drive controlled by differential pressure sensors before and after the bypass arrangement.

Another method of varying the flow rate of the pump to more closely match the flow of refrigerant in the system is shown in FIG. 12. Two pressure sensors, 73 and 74 are attached the liquid line. One of these sensors measures the pressure in the liquid line before the bypass arrangement, pressure P3 and the other measures the pressure in the liquid line just after the bypass arrangement, pressure P4. These two pressure sensors are connected to the pressure regulator 75. The pressure regulator is set to control the pressure differential to a predetermined differential, PD1, as required by the pressure loss in the liquid line between the condenser or receiver and the refrigerant metering device. The pressure controller generates an output control signal that varies linearly as the difference between the preset differential PD1 and the measured pressure differential P4–P3 varies. This variable output signal is input into the controls on a variable speed drive 72. As the pressure differential between the two sensors PD4–PD3 increases above the preset amount PD1, the pressure controller reduces the signal fed to the variable speed drive, and the variable speed drive reduces the speed of the pump until the preset pressure differential PD1 is reached. If the measured pressure differential PD4–PD3 is less than the preset pressure differential PD1 the pressure controller increases the signal fed to the variable speed drive, thereby increasing the speed of the pump.

FIG. 13

Figure 13:
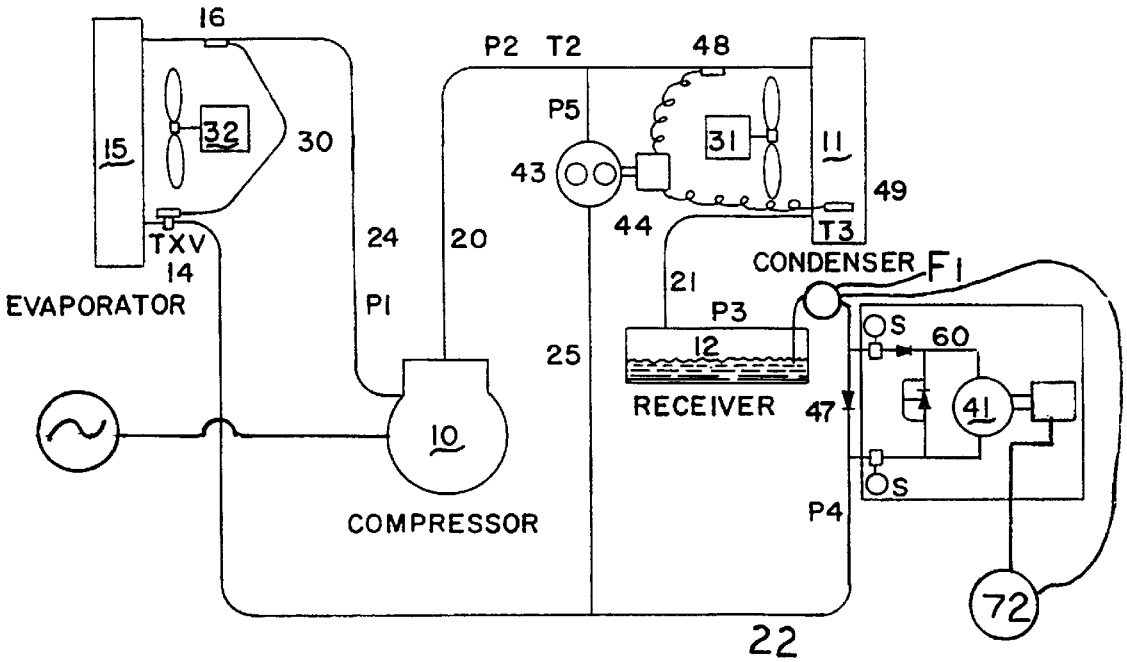
FIG. 13 shows a variable speed drive controlled by a flow sensor at the outlet of the receiver or condenser.
Figure 14:
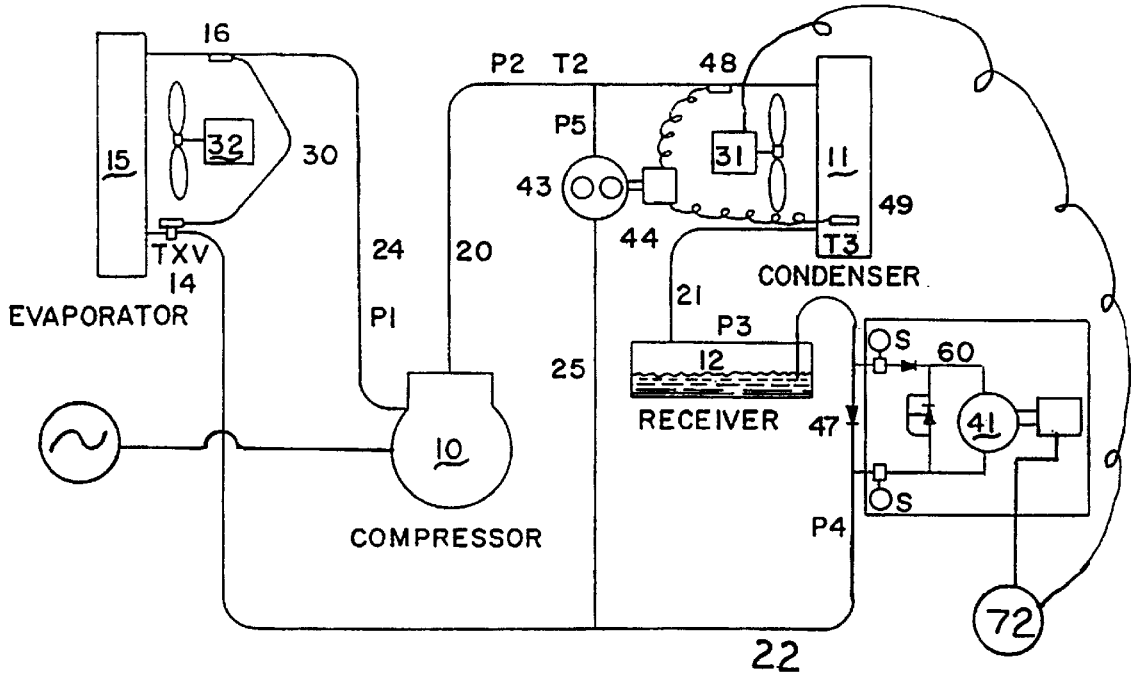
FIG. 14 shows a condenser fan deployment controlled by sensors of amp draw or torque of the variable speed driven pump.

Another method of varying the flow rate of the pump to more closely match the flow of refrigerant in the system is shown in FIG. 13. A flow sensor F1 is placed in the liquid line of the refrigeration system 22 at the outlet of the liquid receiver or condenser. The sensor measures the flow of refrigerant and generates a varying output signal that varies linearly with the variation in refrigerant flow rate. This varying control signal is input to a variable speed drive (72) which drives the pump motor. As the refrigerant flow varies, the control signal from the flow sensor varies and changes the speed of the variable speed drive. This in turn varies the speed at which the pump is operated varying the flow of refrigerant through the pump.

FIG. 14

In order to take advantage of the energy savings possible when employing the current invention, the refrigeration or air conditioning system condensing pressure/temperature is allowed to float lower than the normal factory preset levels. There is a potential for system capacity loss if the pump fails to add pressure to the system when the condensing pressure/temperature is lower than normal. In order to prevent this from occurring when the pump fails to add pressure, the system condensing pressure/temperature control can be raised to its original setting. This can be done with the pump motor variable speed drive mechanism (72). When this mechanism senses a significant reduction of pump motor amp draw or pump torque, it will sent an output signal to the condenser fan controls that will switch them back to their original setting.

System condensing pressure in air cooled systems is controlled by cycling the condenser fans on and off to maintain whatever minimum is required. In order to lower the condensing pressure/temperature, the fans are turned on. In order to maintain or raise the condensing pressure/temperature, the fans are turned off.

FIG. 15

Another method of varying the flow rate of the pump is to measure the condition of the refrigerant at the inlet to the TXV 14. Since the purpose of the present invention is to add pressure to the liquid line to properly feed liquid refrigerant at the proper condition to the TXV, that condition at the inlet of the TXV can be monitored and an output signal sent back to the pump to vary its speed.

Figure 15:
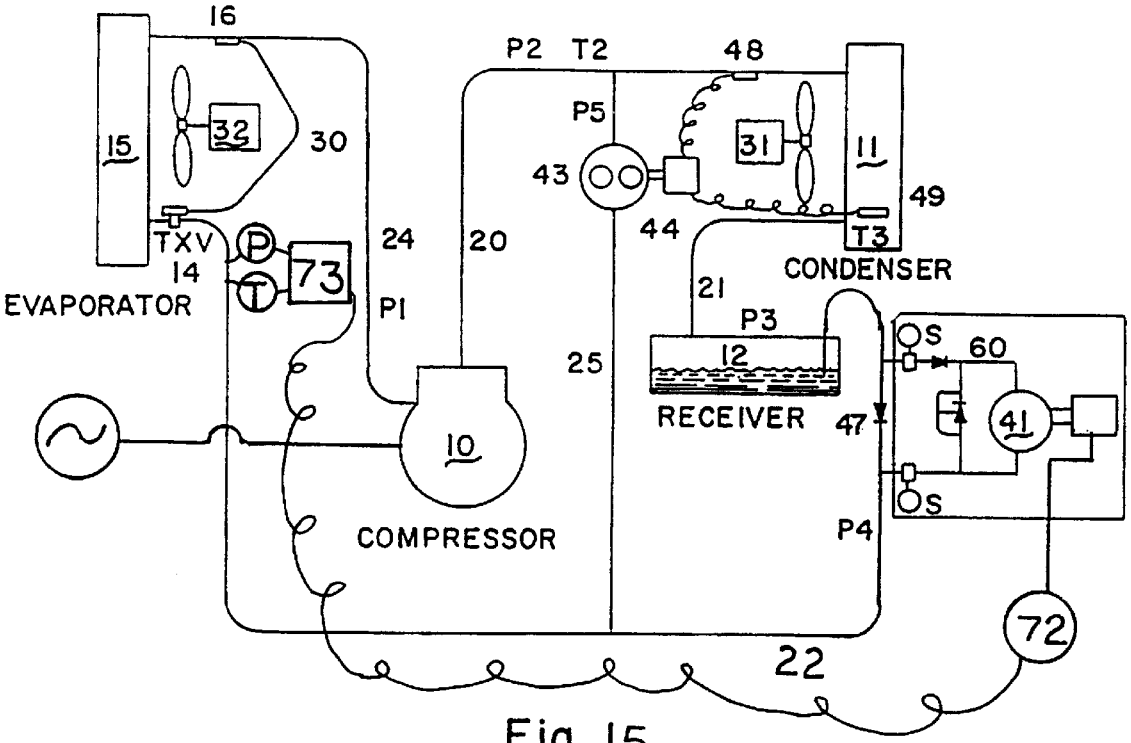
FIG. 15 shows a variable speed drive controlled by a measurement of the "condition", or subcooling, of liquid at the inlet of the expansion valve.
Figure 16:
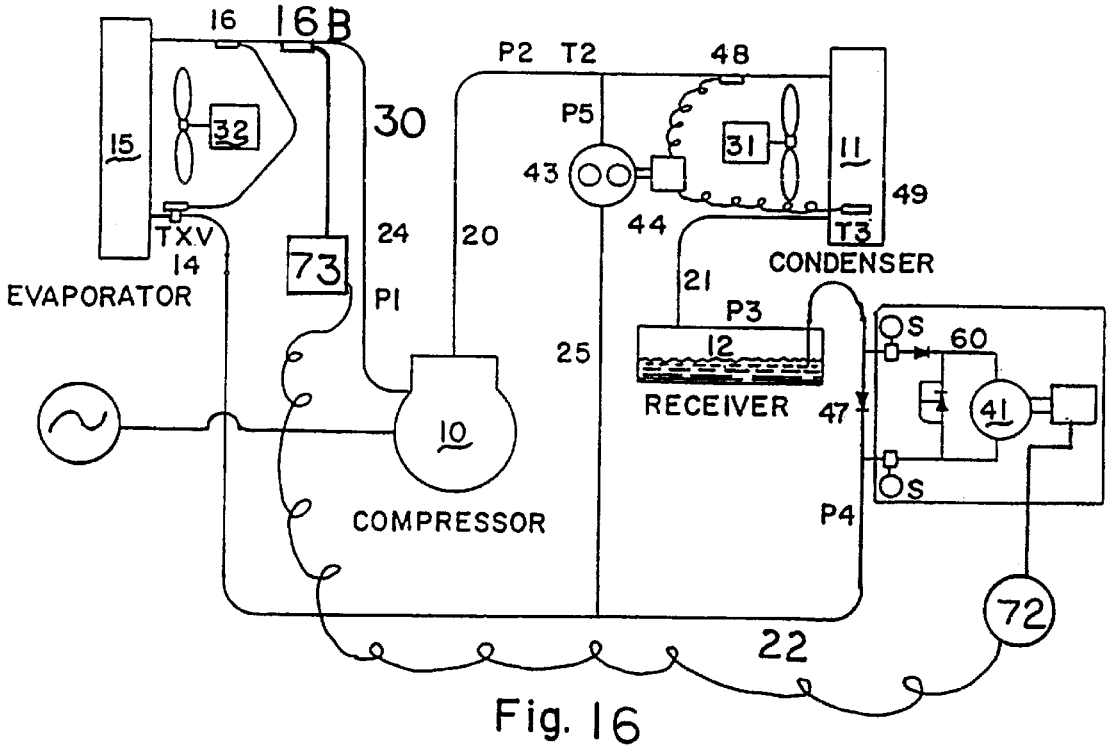
FIG. 16 shows a variable speed drive controlled by a measure of superheating at the outlet of the evaporator.

The condition (amount of subcooling) of the refrigerant at the inlet to the TXV can be determined by monitoring its pressure and temperature as shown in FIG. 15. A pressure sensor P and the temperature sensor T are attached to the liquid line 22 very near the TXV 14. These sensors output either a mechanical or electrical signal to signal analyzer 73 that in turn sends an output signal to the variable speed drive 72 of the pump motor based on a preset minimum pressure and temperature condition. As the amount of subcooling sensed at the inlet to the TXV reduces, the speed of the VSD would increase thereby increasing the pressure in the liquid line and increasing the subcooling.

FIG. 16

Still another method of varying the flow rate of the pump to match the system flow rate is by using a superheat sensor similar to the existing TXV sensing bulb 16. The increase or decrease in pressure in the sensing bulb capillary tube resulting from the increase or decrease in superheat at the outlet of the evaporator acts to move a diaphragm in the control mechanism 73. This movement is translated into an output signal that is in turn fed into the variable speed drive 72 for the pump motor. The higher the superheat sensed by the bulb 16B, the faster the pump motor is turned. This will add more pressure to the liquid line which will feed more liquid into the TXV and the evaporator which will in turn lower the superheat at the sensing bulb 16B. The motor speed will then modulate continuously to hold the superheat to some preset condition similar to the way TXV sensing bulb 16 modulates the TXV.

In addition, there can be any number of different sensor inputs to the signal analyzer and/or controller 73 based on different system variables to control the pump speed for a particular application.

Having described and illustrated the principles of the invention in a preferred embodiment thereof, is should be apparent that the invention can be modified slightly in arrangement and detail without departing from such principles. In that regard, this patent covers all modifications and variations falling within the spirit and scope of the following claims:

We claim:

1. Any refrigeration, air conditioning or process cooling system using a reciprocating screw, scroll, centrifugal or other similar type of compressor and any type of refrigerant, the improvement including a positive-displacement pump used in a parallel piping arrangement which arrangement is parallel to a conventional liquid conduit between a condenser and an expansion valve, and parallel with a check valve, a variable speed drive, driving said positive displacement pump, and a drive controller connected to and controlling said variable speed drive and having as input a signal from a sensor of a variable proportional to refrigerant flow in the system or a related variable, whereby the speed of the positive displacement pump is adjusted to the minimum speed necessary to add a predetermined increment of pressure to the liquid conduit or to eliminate flash gas.

2. A system as recited in claim 1, wherein the system includes a control system which sets the minimum condensing temperature setting of refrigerant exiting the condenser to a lower-than-conventional value when the pump is functioning properly and reverts the air conditioning or refrigeration system back to the higher minimum condensing temperature setting in case of failure of the pump.

3. A system as recited in claim 1 further characterized by the provision of:

a compressor rack having an electrical power source, and a sensor of amperage draw by the compressor rack producing a signal proportional to said amperage draw and communicating with said drive controller to control said pump speed.

4. A system as recited in claim 1 further characterized by the provision of:

a pressure sensor in said liquid conduit producing a signal proportional to said pressure and communicating with said drive controller to control said pump speed.

5. A system as recited in claim 1 further characterized by the provision of:

a pair of pressure sensors at, respectively, the input and output of the pump assembly producing a combined signal proportional the pressure differential across the pump and communicating with said drive controller to control said pump speed.

6. A system as recited in claim 1 further characterized by the provision of:

a flow sensor in the liquid conduit at the outlet of the liquid receiver or condenser producing a signal proportional to the liquid flow rate and communicating with said drive controller to control said pump speed.

7. A system as recited in claim 1 further characterized by the provision of:

a vapor sensor in the liquid conduit communicating with said drive controller to control said pump speed sufficiently to eliminate the vapor.

8. A system as recited in claim 1 further characterized by the provision of:

a compressor rack having an electrical power source and a rack controller, said rack controller communicating with said drive controller to control said pump speed according to the same inputs received by said rack controller.

9. A system as recited in claim 1 further characterized by the provision of:

a sensor of the amount of subcooling of the refrigerant at the inlet to the expansion valve and communicating with said drive controller to control said pump speed.

10. A system as recited in claim 1 further characterized by the provision of:

a superheat sensor at the outlet of the evaporator providing a signal proportional to the degree of superheat and communicating with said drive controller to control said pump speed.

11. A system as recited in claim 1, wherein the system includes a liquid injection line between the output of the pump and the output of a compressor, used for de-superheating the compressor discharge vapor, and a thermostatic expansion valve and sensing bulb to control the flow of liquid refrigerant through the injection line.

12. A vapor-compression heat transfer system having fluid refrigerant, a compressor, a condenser, an expansion valve, an evaporator, a refrigerant conduit between the condenser and the expansion valve, and a refrigerant pump in the conduit adapted to increase the pressure of the refrigerant between the condenser and the expansion valve, the improvement comprising (a) the fact that the said pump is a positive displacement pump, and (b) a bypass conduit is provided in parallel around the pump, said bypass conduit including a check valve adapted to stop flow of refrigerant through the said bypass conduit from the expansion valve to the condenser, but to allow flow of refrigerant through the said bypass conduit from the condenser to the expansion valve, (c) said pump and bypass conduit being adapted to increase the said pressure of the refrigerant-sufficiently to avoid the formation of refrigerant flash gas in said conduit between the pump and the expansion valve, while still allowing flow of refrigerant from the condenser to the expansion valve if the pump fails to operate, (d) a variable speed drive, driving said positive displacement pump, and (e) a drive controller connected to and controlling said variable speed drive and having as input a signal from a sensor of a variable proportional to refrigerant flow in the system or a related variable, whereby the speed of the positive displacement pump is adjusted to the minimum speed necessary to add a predetermined increment of pressure to the liquid conduit or to eliminate flash gas.

13. A vapor-compression heat transfer system as recited in claim 12, wherein a liquid injector conduit is provided between an output side of the pump to an output side of the compressor, and adapted to deliver pressurized liquid refrigerant de-superheat the refrigerant when it exits the compressor.

14. A vapor-compression heat transfer system as recited in claim 13, wherein the liquid injector conduit includes a thermostatic expansion valve and bulb sensor to monitor the temperature of the gas exiting the compressor so as to minimize the superheat in the refrigerant.

15. A vapor-compression heat transfer system as recited in claim 13, wherein a control system is provided to cause reduction in the minimum condensing temperature at the outlet of the condenser when the pump is effectively reducing flash gas, but the control system is adapted to raise the minimum condensing temperature to a point which reduces flash gas, if the pump fails to operate.

* * * * *